US005923126A

United States Patent [19]

Yang et al.

[11] Patent Number: 5,923,126

[45] Date of Patent: Jul. 13, 1999

[54] FLUORESCENT LAMP ELECTRONIC BALLAST WITH RAPID VOLTAGE TURN-ON AFTER PREHEATING

[75] Inventors: Kevin Yang, Chula Vista; Chien F. Chao, Rancho Palos Verdes; John Yu, Torrance; Albert Peng, Long Beach; Feng Hu, Palos Verdes Estates, all of Calif.

[73] Assignee: Philips Electronic North America Corporation, New York, N.Y.

[21] Appl. No.: 08/708,005

[22] Filed: Aug. 9, 1996

[51] Int. Cl.[6] ..... H05B 37/02

[52] U.S. Cl. ..... 315/102; 315/106; 315/107; 315/219

[58] Field of Search ..... 315/106, 107, 315/102, 94, 97, 99, 219

[56] References Cited

U.S. PATENT DOCUMENTS

| | | | |
|---|---|---|---|
| 4,256,992 | 3/1981 | Luursema | 315/106 |
| 4,682,080 | 7/1987 | Ogawa et al. | 315/106 |
| 4,746,841 | 5/1988 | Ogawa | 315/106 |
| 4,928,039 | 5/1990 | Nilssen | 315/209 |
| 4,937,498 | 6/1990 | Bolhuis et al. | 315/240 |
| 4,954,749 | 9/1990 | Crawford | 315/106 |
| 5,059,868 | 10/1991 | El-Hamamsy et al. | 315/248 |

OTHER PUBLICATIONS

Japanese abstract 3,184,299A Aug. 12, 1991.

*Primary Examiner*—Robert Pascal
*Assistant Examiner*—Michael B Shingleton
*Attorney, Agent, or Firm*—Bernard Franzblau; Jack D. Slobod

[57] ABSTRACT

An electronic ballast for a fluorescent lamp includes a delay triggered circuit which, upon expiration of a predetermined period during which the lamp filaments, constituting opposite electrodes of the lamp, are preheated, applies high frequency operating voltage across the opposite electrodes of the lamp beginning with a transition from a condition of no voltage to a condition of full rated voltage which occurs within one cycle of the high frequency voltage. The sharp transition from zero "glow current" to full "arc current" at the end of the preheating period has been found to increase the life of lamps in the number of on-off starts, particularly with respect to lamps of poor quality. The rapid transition is possible because the ballast uses the same inverter and transformer for supplying preheating and operating voltages. The operating voltage is applied between the opposite electrodes of the lamp via an electronic bi-directional switch, controlled by a preheating delay RC timing circuit.

16 Claims, 3 Drawing Sheets

FLUORESCENT LAMP ELECTRONIC BALLAST WITH RAPID VOLTAGE TURN-ON AFTER PREHEATING

BACKGROUND OF THE INVENTION

1. Field of the Invention

The present invention relates to an electronic ballast circuit for starting and powering a vapor discharge lamp having a phosphor layer for emitting light, commonly known as a fluorescent lamp, in which filaments constituting opposite electrodes of the lamp are preheated for a predetermined period of delay after which a high frequency operating voltage is applied across opposite electrodes of the lamp. The invention also relates to a method of starting a fluorescent lamp to improve the life of the lamp.

2. Description of the Related Art

Circuits for powering metal vapor fluorescent lamps which start the lamps in a manner in which filaments are first preheated are known from U.S. Pat. Nos. 4,256,992 and 4,928,039. Therein, as is common, lamps operate on a voltage of alternating polarity (usually more than 30 KHz) such that filaments constituting electrodes at opposite ends of the lamp alternately serve as cathodes in each cycle. These circuits cause the filaments to be conditioned by being preheated to incandescence during a predetermined period of about two seconds prior to turning on the lamp. In the circuits described, the operating voltage does not go through a sharp on to off transition since at least a separate inverter is started to produce the operating voltage, producing oscillations which take numerous cycles to build and stabilize.

The filaments constituting the lamp's electrodes are generally made from coiled tungsten wire and are coated with a material for enhancing their thermionic emission of electrons. During lamp operation, and particularly during turn on, tungsten and emitter material can evaporate or sputter from the electrodes. The amount of such evaporation and sputtering determines the lamp's remaining starting life (the estimated number of on-off starts until the lamp fails). Lamps of relatively poor quality, particularly in lamp applications with electronic ballasts employing so-called "rapid start" circuits, are particularly susceptible to the early appearance of end blackening of the lamp sidewall, which evidence that the filaments have already deteriorated due to excessive sputtering of filament materials and that the remaining starting life of the lamp is quite limited. In such lamps of poor quality end blackening may appear after as little as several hundred on-off starts.

SUMMARY OF THE INVENTION

Since electronic ballasts must operate with lamps of arbitrary quality, it is a primary object of the present invention to provide a ballast for a fluorescent lamp and a method of starting such a lamp which substantially maximizes the useful life of lamps, even lamps of poor quality.

In this respect, the present invention involves the discovery that the life of fluorescent lamps, particularly those of poor quality, can be extended by conditioning and turning on the lamp in a manner that during a predetermined period of delay, while the filaments constituting the opposite electrodes of the lamp are preheated to the correct temperature, no voltage should be applied across the opposite electrodes so that there is no lamp current flowing therebetween (a condition of so-called zero "glow current"). Then, after the preheating is completed, the operating voltage should be applied quickly to produce an almost instantaneous transition from no lamp current to full lamp current (so-called "arc current").

In accordance with the present invention, a ballast for a fluorescent lamp includes an inverter which produces an output voltage of alternating polarity, at a high frequency, means for developing preheating and operating voltages from the output of the inverter, first coupling means for coupling the preheating (i.e. first) voltage to the filaments for preheating during a predetermined preheating period, and second coupling means, including a timed switch, for coupling the operating (second) voltage between the opposite electrodes upon the expiration of the preheating period. The second coupling means is configured to produce a sharp transition between a condition of no voltage and a condition of rated peak voltage between the electrodes. In fact, such transition must be so sharp as to occur within one cycle of the initial value of the high frequency.

The means for developing the first and second voltages comprises a transformer having a primary winding fed by the output of the inverter, first and second secondary windings coupled to the respective filaments by the first coupling means, and a third secondary winding coupled between said electrodes by said second coupling means.

The rapid transition from no to full operating voltage applied between the filaments is possible because the ballast circuit employs a single inverter from which both the preheating voltage and the operating voltage are developed and uses the same transformer for supplying both the preheating current and the lamp current. Thus, this transformer has a primary winding which is fed by an inverter, first and second secondary windings which feed the filaments, and a third secondary winding which provides the operating voltage between the filaments via the timed switch circuit. A fourth secondary winding feeds the timed switch circuit. Since the operating voltage exists across the third secondary winding during the preheating period prior to the triggering or rapid switching of the timed switch circuit, a rapid transition from no to full voltage appears between the filaments at the expiration of the preheating interval.

The timed switching circuit is implemented by a timing portion employing an RC network having a time constant determining the period of delay during which the preheating takes place, and a rapid switching electronic bidirectional switch means. According to one embodiment, a triac is used as the bidirectional switch means, whereas, in another embodiment a transistor is utilized in conjunction with a diode bridge. The transistor may be a bi-polar transistor controlled by a FET whose gate is directly connected to an RC timing circuit, or alternatively, the FET may serve as the bridge transistor.

The invention is also directed to a method for starting a metal vapor lamp including the steps of developing preheating and operating voltages at an initial frequency and coupling the preheating voltage to filaments of the lamp, constituting its opposite electrodes, during a predetermined preheating period during which a condition of no voltage is maintained between the opposite electrodes, and coupling the operating voltage between the electrodes upon expiration of said predetermined preheating period in a manner to produce upon expiration of the preheating period a transition from the condition of no voltage to a condition of rated peak voltage between the electrodes which occurs within one cycle of the initial frequency of the developed operating voltage.

Other objects, features and advantages of the present invention will become apparent upon perusal of the following detailed description when taken in conjunction with the appended drawing, wherein:

DETAILED DESCRIPTION OF THE PREFERRED EMBODIMENTS

As previously noted herein, the present invention is based on the discovery that the life of fluorescent lamps, particularly those of poor quality, can be extended by starting the lamp in a manner that during a predetermined preheating period, while the filaments constituting the opposite electrodes of the lamp are preheated, no voltage should be applied across the opposite electrodes and upon expiration of the preheating delay, the operating voltage should be applied or triggered to produce a sharp transition from no voltage to full rated voltage.

Figure 1:
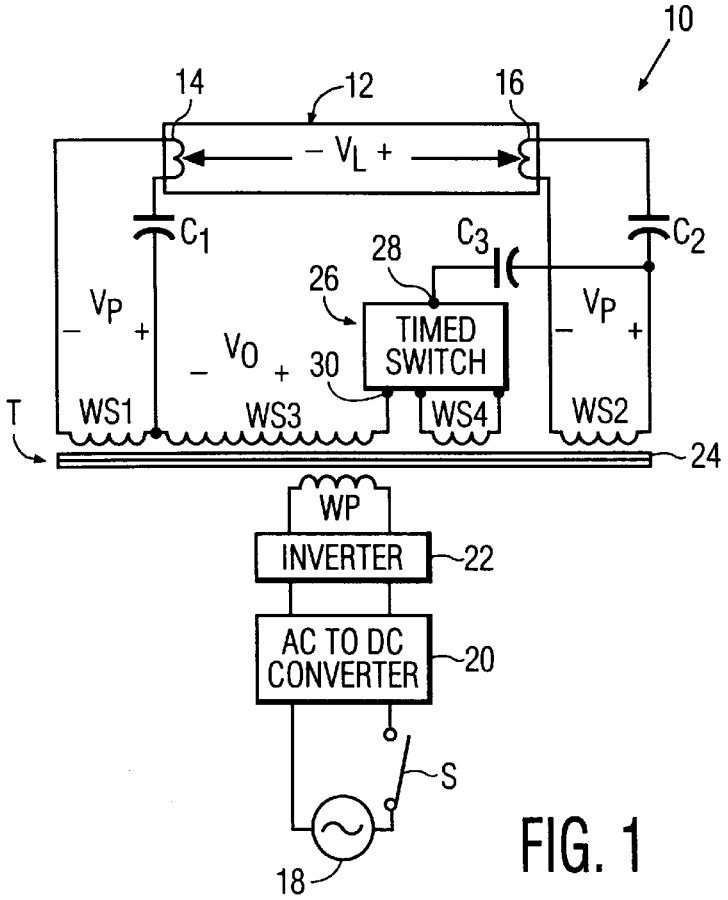
FIG. 1 is a schematic diagram of an electronic ballast, including a timed switch, in accordance with the invention in conjunction with a fluorescent lamp.

This is accomplished using the ballast circuit 10 of the present invention generally shown in FIG. 1 of the drawing in conjunction with a mercury (or other suitable metal) vapor fluorescent lamp 12 having filaments 14 and 16 constituting opposite electrodes of the lamp. As is common, ballast 10 is powered from a source of AC line voltage which is applied via a switch S to an AC to DC converter 20 in the form of a diode rectifier bridge (not shown) to produce an internal source of DC voltage. This DC voltage is converted to a high frequency voltage of alternating polarity by an inverter 22 which drives the primary winding WP of a transformer T. The frequency thereof is greater than 30 KHz, and preferably initially in the range of 62 to 65 KHZ. In case the available line voltage is DC, converter 20 is omitted, and switch S is between the source of line voltage and inverter 22. In either case, inverter 22 is turned on when switch S is closed.

Transformer T has a core 24, a pair of secondary windings WS1, WS2, each of which develop the preheating voltage $V_P$, a third secondary winding WS3 which develops the operating voltage $V_O$, and a fourth secondary winding WS4 which energizes a timed switch 26. Secondary windings WS1, WS2 are respectively connected across filaments 14, 16 via coupling capacitors C1, C2 to apply the preheating voltage $V_P$ thereto. Secondary winding WS3 is connected between the electrodes constituted by filaments 14, 16 via a high current path which includes terminals 28, 30 of timed switch 26, coupling capacitors C1, C2 and a third coupling capacitor C3.

Figure 5A:
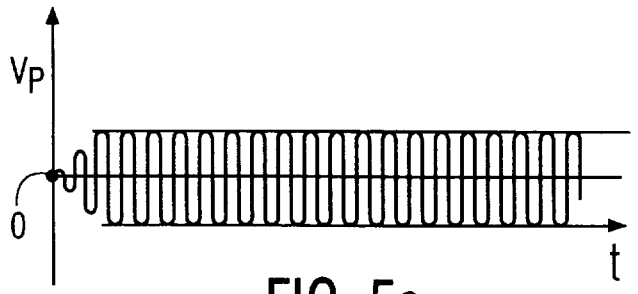
FIGS. 5*a*, 5*b* and 5*c* are aligned graphs of various voltages in FIGS. 1–4 versus time.

As appears from FIG. 5*a*, in response to closure of switch S and turn on of inverter 22 at time t=0, the preheating voltage $V_P$ is developed across each of secondary windings WS1, WS2 and applied to filaments 14, 16. As further appears from FIG. 5*c*, while the operating voltage $V_O$ is at the same time also developed across secondary winding WS3, the voltage $V_L$ between the electrodes constituted by filaments 14, 16 is initially a zero open circuit voltage, producing a so-called zero "glow current" flowing between the electrodes. At a time $t_1$, of about two seconds, the predetermined preheating delay after turn on of inverter 22 expires and a current path rapidly appears between terminals 28, 30, producing a transition from the condition of no voltage between the electrodes, to a condition of full rated peak amplitude within one cycle of the initial frequency of inverter 22, turning on lamp 12. As is well known, the additional load due to turn on of the lamp will reflect into a tank circuit (not shown) in inverter 22 and cause a reduction in the frequency of inverter 22, for example, to a working frequency of about 45 KHZ, but the rated peak amplitude of the operating voltage is maintained.

Filaments 14, 16 each have an initial cold resistance on the order of 1 ohm, but due to heating the resistance of each will increase to 8 to 10 ohms. This increase in resistance as well as the increase in capacitive reactance of coupling capacitors C1, C2 due to the aforementioned reduction in frequency of the inverter after lamp turn on, limits the filament power after lamp turn on to an appropriate low level.

Figure 2:
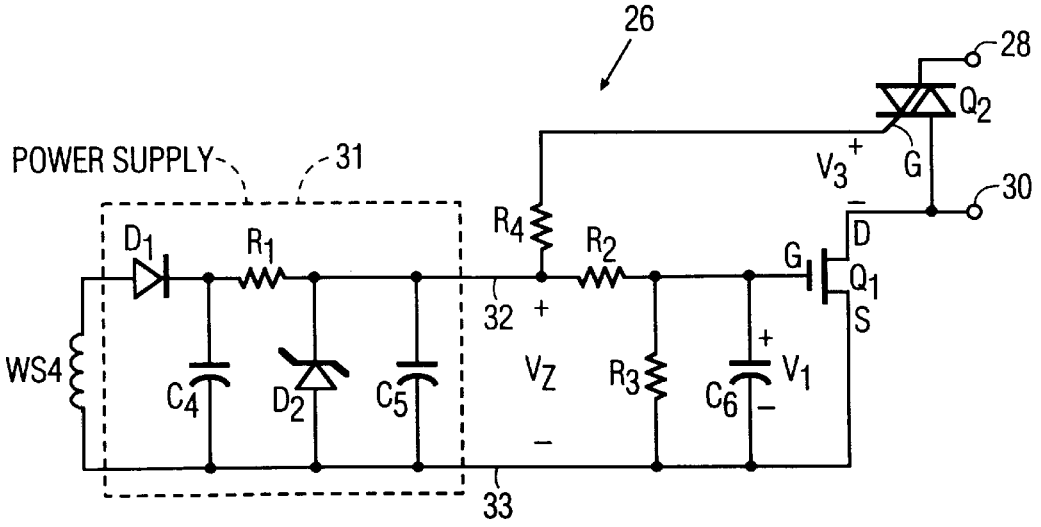
FIGS. 2, 3 and 4 are alternate embodiments of the timed switch in FIG. 1.

As shown in FIG. 2, timed switch 26 comprises a bi-directional electronic switch in the form of a triac Q2 whose high current terminals form terminals 28, 30 of switch 26 and whose gate is responsive to a control voltage $V_3$, to trigger triac Q2 into an on condition.

Secondary winding WS4 is used to energize a regulated DC power supply 31 constituted by a network whose elements are a diode D1, a capacitor C4, a resistor R1, and a parallel combination of a zener diode D2 and a capacitor C5 across which the output voltage $V_Z$ of power supply 31, equal to the zener voltage of diode D2, is formed. This output voltage, which appears across output terminals 32, 33 of power supply 31 in response to turn on of inverter 22 (FIG. 1), feeds the series combination of a resistor R2 and the parallel combination of a resistor R3, a capacitor C6, and the gate to source junction of a FET Q1. The drain of FET Q1 is connected to terminal 30 and the positive output terminal 32 of power supply 31 is connected to the gate of triac Q2 via a resistor R4.

Figure 5B:
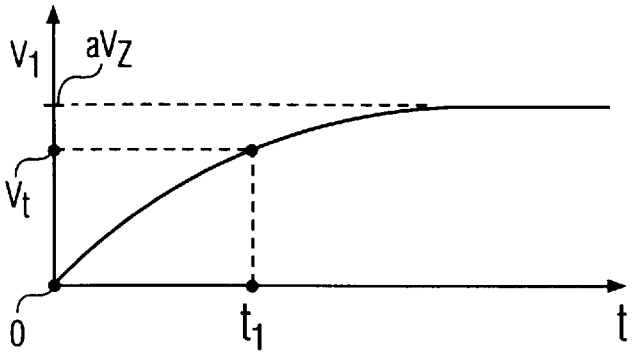
Figure 5C:
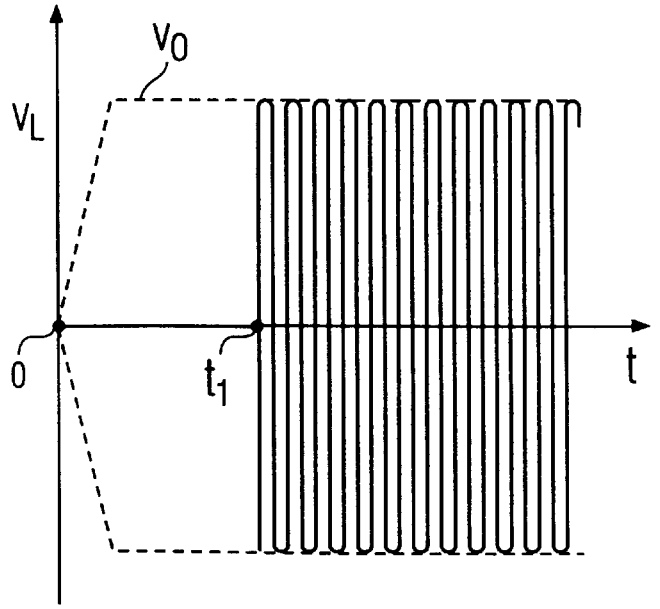

The operation of the embodiment of timed switch 26 shown in FIG. 2 should now be apparent by also referring to FIG. 5*b*. The resistors R2, R3 and the capacitor C6 form an RC timing circuit in which capacitor C6 is charged toward a voltage $V_1=a\cdot V_Z$, where a=R3/(R2+R3), with a time constant $\tau=a\cdot R2\cdot C6$. At the time $t_1$ when voltage $V_1$ reaches a voltage $V_t$ sufficient to turn on FET Q1, then V3 jumps from zero to $V_Z$ triggering triac Q2.

Figure 3:
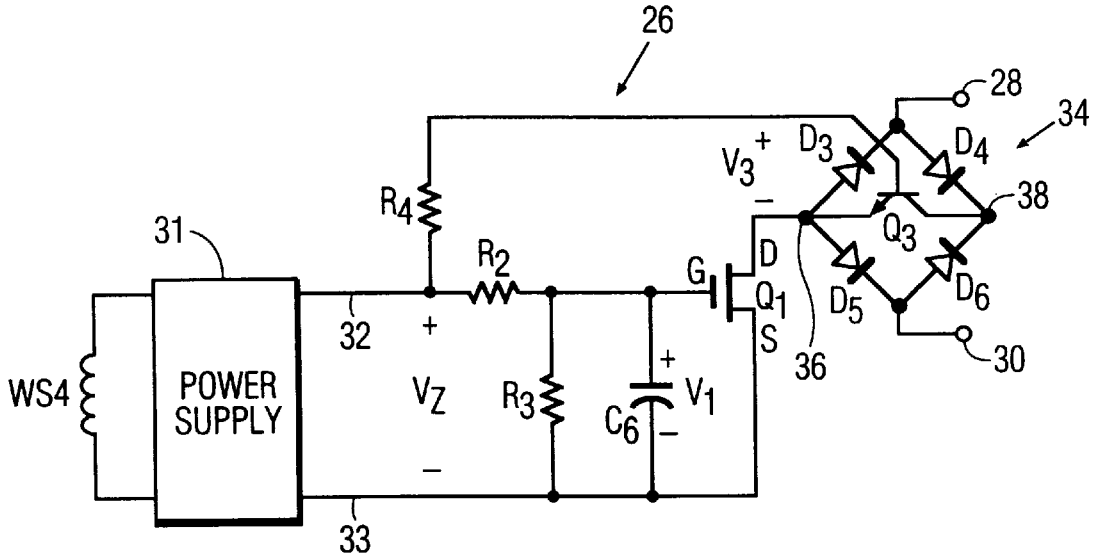

The embodiment of timed switch 26 shown in FIG. 3 is the same as in FIG. 2 except that triac Q3 is replaced by the combination of a bridge formed of diodes D3, D4, D5, and D6 and a bipolar transistor Q3. One pair of opposite nodes of the bridge form the terminals 28, 30 and the other pair of opposite nodes 36, 38 are connected to the collector and emitter, respectively, of transistor Q3. Similar to the embodiment shown in FIG. 2, the base to emitter junction is responsive to the control voltage $V_3$.

Figure 4:
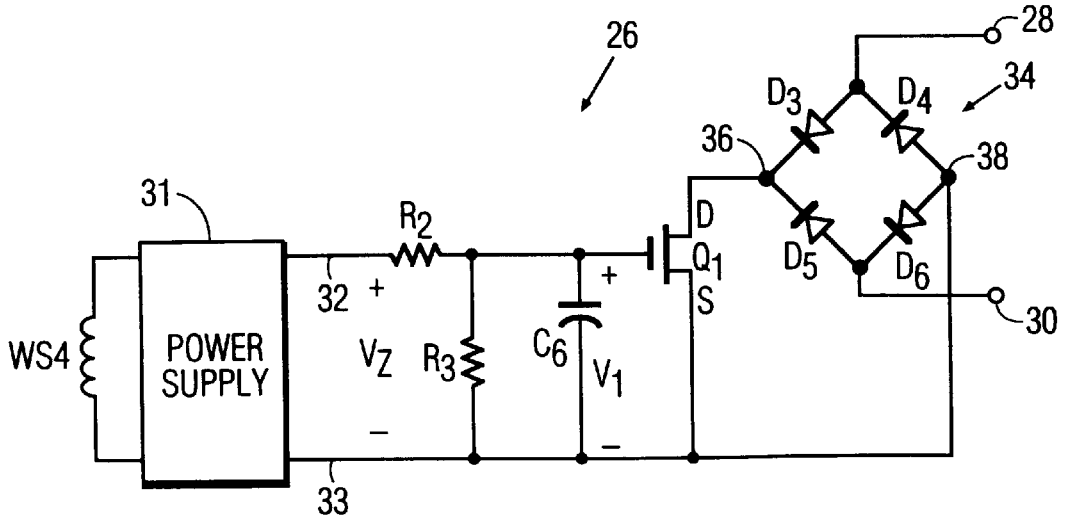

The embodiment of FIG. 4 is similar to that of FIG. 3, with the main exception that the bipolar transistor Q3 is eliminated and the FET Q1 is used to complete the circuit through bridge 34 when FET Q1 is turned on. In this embodiment, resistor R4 is also eliminated, the diodes D3 through D6 are reversed in orientation, and node 38 is connected to the source of FET Q1. Further, diodes D3 and D5 must be avalanche diodes to protect the FET Q1, which itself must be a suitably high voltage device.

In testing the ballast circuit of the present invention, it has been found that it has taken over 45,000 on-off starts before the appearance of end blackening in lamps of the same type which had end blackening appear after several hundred on-off starts with a prior art ballast circuit. It should thus be apparent that the objects of the present invention have been satisfied.

While the present invention has been described in particular detail, it should also be appreciated that numerous modifications are possible within the intended spirit and scope of the invention.

What is claimed is:

1. A ballast device for powering a metal vapor lamp having a pair of preheatable filaments constituting respective opposite electrodes of the lamp, said ballast device comprising: an inverter having an output alternating in polarity to produce cycles at an initial high frequency in response to a turn on of said inverter, means for developing preheating and operating voltages in response to said inverter output, first means for coupling said preheating voltage to said filaments during a predetermined preheating period during which a condition of no voltage is maintained between the opposite electrodes, and second means for coupling said operating voltage between said electrodes upon expiration of said predetermined preheating period after the turn on of said inverter, wherein the second coupling means is configured to produce, upon expiration of said preheating period, a transition from the condition of no voltage to a condition of rated peak voltage between said electrodes which occurs within one cycle of said initial high frequency.

2. A ballast device as claimed in claim 1, wherein the second coupling means includes a timed switch means coupled intermediate the voltage developing means and at least one of said electrodes.

3. A ballast device as claimed in claim 2, wherein said timed switch means further comprises an electronic bi-directional switch means for completing a circuit path between said voltage developing means and said at least one of said electrodes, said bi-directional switch means having a control input, and timed control means for sensing turn on of said inverter and for applying a control signal to said control input after the expiration of said preheating period.

4. A ballast device as claimed in claim 1, wherein said means for developing operating and preheating voltages comprises a transformer having a primary winding which is fed by an inverter, first and second secondary windings which develop the preheating voltage for the respective filaments, and a third secondary winding which develops the operating voltage.

5. A ballast device as claimed in claim 2, wherein said means for developing operating and preheating voltages comprises a transformer having a primary winding which is fed by an inverter, first and second secondary windings which develop the preheating voltage for the respective filaments, and a third secondary winding which develops the operating voltage.

6. A ballast device as claimed in claim 3, wherein said means for developing operating and preheating voltages comprises a transformer having a primary winding which is fed by an inverter, first and second secondary windings which develop the preheating voltage for the respective filaments, and a third secondary winding which develops the operating voltage.

7. A ballast device as claimed in claim 5, wherein said transformer further comprises a fourth secondary winding feeding said timed switch means.

8. A ballast device as claimed in claim 2 wherein said timed switch means is controlled by an output voltage of said inverter.

9. A ballast device as claimed in claim 3, wherein said electronic bi-directional switch means comprises a diode bridge having a pair of opposite nodes connected by a transistor.

10. A ballast device as claimed in claim 9, wherein said transistor is a bipolar transistor.

11. A ballast device as claimed in claim 9, wherein said transistor is a FET.

12. A ballast device as claimed in claim 11, wherein said FET has a gate constituting said control input which is directly connected to an RC timing circuit within said timed control means.

13. A ballast device as claimed in claim 3, wherein said electronic bi-directional switch means comprises a triac.

14. A ballast device as claimed in claim 6, wherein said transformer further comprises a fourth secondary winding feeding said timed control means.

15. A ballast device as claimed in claim 14 wherein said timed control means is controlled by an output voltage of said inverter via said transformer.

16. A method for starting a metal vapor lamp having a pair of preheatable filaments constituting respective opposite electrodes of the lamp, said method comprising: developing preheating and operating voltages at an initial high frequency and coupling said preheating voltage to said filaments during a predetermined preheating period during which a condition of no voltage is maintained between the opposite electrodes, and coupling said operating voltage between said electrodes upon expiration of said predetermined preheating period in a manner to produce upon expiration of said preheating period a transition from the condition of no voltage to a condition of rated peak voltage between said electrodes which occurs within one cycle of said initial high frequency.

* * * * *